United States Patent [19]

Lay

[11] Patent Number: 4,941,406

[45] Date of Patent: Jul. 17, 1990

[54] MAGNETIC AND AERODYNAMIC LEVITATION VEHICLE

[76] Inventor: Joachim E. Lay, 5371 Wild Oak Dr., East Lansing, Mich. 48823

[21] Appl. No.: 204,542

[22] Filed: Jun. 9, 1988

[51] Int. Cl.[5] ..... B61B 13/08; B64F 3/00

[52] U.S. Cl. ..... 104/23.1; 104/281; 105/1.2

[58] Field of Search ..... 104/23.1, 281–284, 104/286, 242, 243, 245–248, 287, 288; 105/1.2, 64.2, 74, 77, 141, 144, 142–147; 238/130

[56] References Cited

U.S. PATENT DOCUMENTS

| | | | |
|---|---|---|---|
| 3,143,977 | 8/1964 | Deller | 105/144 |
| 3,575,454 | 3/1971 | Meeker | 105/145 X |
| 3,589,300 | 6/1971 | Wipf | 104/286 X |
| 3,675,582 | 7/1972 | Girard et al. | 104/23.1 |
| 3,677,188 | 7/1972 | Bordes | 105/441 X |
| 3,834,318 | 9/1974 | Fellows et al. | 104/286 X |
| 3,841,227 | 10/1974 | Fink | 104/281 X |
| 3,858,521 | 1/1975 | Atherton | 104/286 X |
| 3,899,979 | 8/1975 | Godsey, Jr. | 104/283 |
| 3,919,944 | 11/1975 | Jorg | 104/23.1 |
| 4,703,697 | 11/1987 | Bell | 104/23.1 |
| 4,709,883 | 12/1987 | Giuliani et al. | 104/281 X |

FOREIGN PATENT DOCUMENTS

| | | | |
|---|---|---|---|
| 760521 | 6/1967 | Canada | 104/281 |
| 52-71014 | 6/1977 | Japan | 104/281 |

*Primary Examiner*—Margaret A. Focarino
*Assistant Examiner*—Joseph D. Pape
*Attorney, Agent, or Firm*—Ian C. McLeod

[57] ABSTRACT

A vehicle (10) mounted on a T-shaped rail (100) and having wings (11) providing lift is described. The vehicle uses magnets (18) on the vehicle and materials (101) attracted by the magnet on the rail to provide magnetic levitation. Propulsion is provided by a motor (15). The vehicle is adapted for high speed travel slightly above the ground.

4 Claims, 2 Drawing Sheets

MAGNETIC AND AERODYNAMIC LEVITATION VEHICLE

BACKGROUND OF THE INVENTION (1) Field of the Invention

The present invention relates to a winged vehicle which is mounted on T-shaped rails by means of a T-shaped slot in the vehicle. In particular the present invention relates to a winged vehicle which uses magnetic attraction means between the rail and vehicle to levitate the vehicle as the wings provide lift.

(2) Prior Art

Magnetically levitated Maglev trains, propelled by linear induction motors, have been under development for many years. Hermann Kemper, a German, first developed the concept in 1935. However, his development went without notice until 1960, when two companies, Kraus-Maffei and Messerschmitt-Bolkow-Blohm, began development work with financial aid from the German government. Currently, there are basically two kinds of magnetic levitation, using either (1) repulsive force between vehicle-borne superconducting magnets and induced currents in guideway conductors, or (2) attractive force between iron-core electromagnets on the vehicle and ferromagnetic rails. The first type is referred to as electrodynamic suspension (EDS), and the second type is called electromagnetic suspension (EMS). Their characteristics are given in Table 1.

TABLE 1

| | Characteristics of Maglev Systems | |
|---|---|---|
| | EDS(repulsion mode) | DMS(attraction mode |
| Magnets | superconducting coils | Iron-core electro-magnets |
| Guideway components | Aluminum strips or multiple-turn coils | Laminated or solid ferromagnetic strips |
| Liftoff speed | 40 to 80 km/h | Magnetically suspended at all speeds |
| Guideway clearance | 100 to 150 mm | 10 to 15 mm |
| Stability | Dynamically stable: no feedback control necessary; damping required for good ride quality | Inherently unstable: feedback control necessary to maintain dynamic stability |
| Compatible propulsion systems | Air-core linear-synchronous motor | Iron-core linear synchronous motor or linear induction motor |

Maglev trains are in commercial service, one connecting the Birmingham, England airport with a rail terminal in the National Exhibition Centre, and the other is the German transrapid (TR) 06 vehicle.

All attractive systems need a variable-voltage, variable-frequency inverter to supply the power. On a large vehicle, this is a heavy piece of equipment. The situation may be alleviated somewhat by putting the excitation on the guideway. The inverter then becomes ground equipment instead of vehicle equipment and the weight and cost of the vehicle goes down. Had the powered magnets been aboard, the whole train would be full of inverters, since the kVA (kilo-volts times amperes) required at high speeds is very great. By having the power on the wayside, the vehicles are a lot lighter and cheaper, but guideway costs are higher.

Repulsive levitation also has its drawbacks, although the system gets better as it gets bigger. Repulsive levitation requires wheels or another means of suspension for slow-speed running. This is because the current strength and repulsion field induced in the coils or continuous metal plates provide lift only when magnets reach 20 mph. Superconducting magnetic fields will penetrate an aluminum sheet until at about 20 mph the eddy-current magnetic field repels it. Another problem is the magnetic drag inherent in repulsive levitation. As the vehicle begins to pick up speed, magnetic drag climbs steadily, although at about 20 mph it begins to fall off.

As for maglev propulsion, Siemens' initial design of a repulsive-levitation vehicle calls for a double-sided linear induction motor (LIMK) in the vehicle straddling a continuous vertical reaction rail along the guideway. The on-board sandwich-type primary windings correspond to the fixed armature surrounding the spinning rotor in an ordinary motor. The magnetic field of the LIMK windings induces currents and opposing fields in the fixed reaction rail (secondary), which corresponds to a rotor. The interaction of opposing fields spins the rotor in an ordinary motor, but thrusts the LIMK primary and attached maglev vehicle linearly along the reaction rail. Such on-board LIMK primaries requires enormous electrical input through flexible collection arms that make contact with power rails paralleling the guideway. Thus, the major obstacle, is the shortage of electrical energy. A major breakthrough in electrical generation (like fusion power) must happen first, before high-speed maglevs become practical.

OBJECTS

It is therefore an object to provide a vehicle which reduces the magnetic lift necessary to propel and/or lift the vehicle while it is in motion. Further it is an object of the present invention to provide a vehicle which can be manufactured using well known techniques for the manufacture of aircraft. These and other objects will become increasingly apparent by reference to the following description and the drawings.

IN THE DRAWINGS

Figure 1:
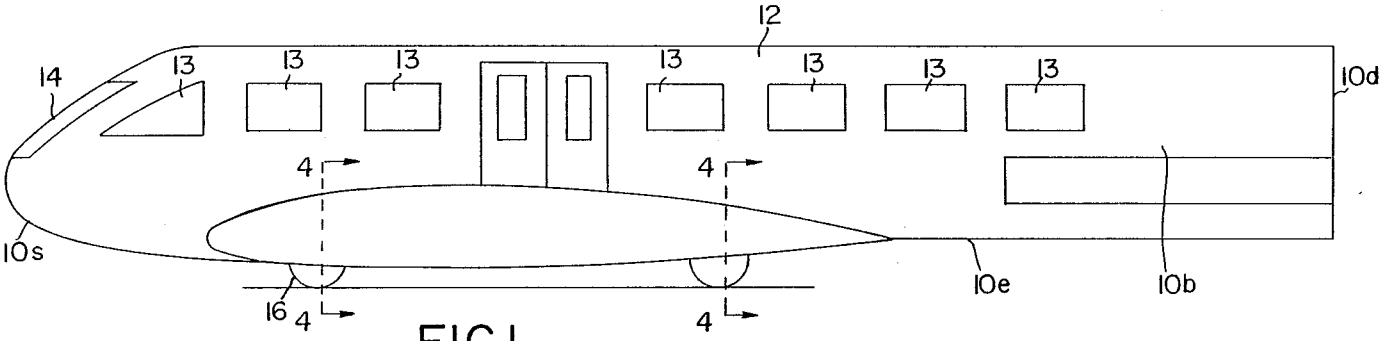
FIG. 1 is a side view of the vehicle 10 of the present invention, particularly showing the wings 11.
Figure 2:
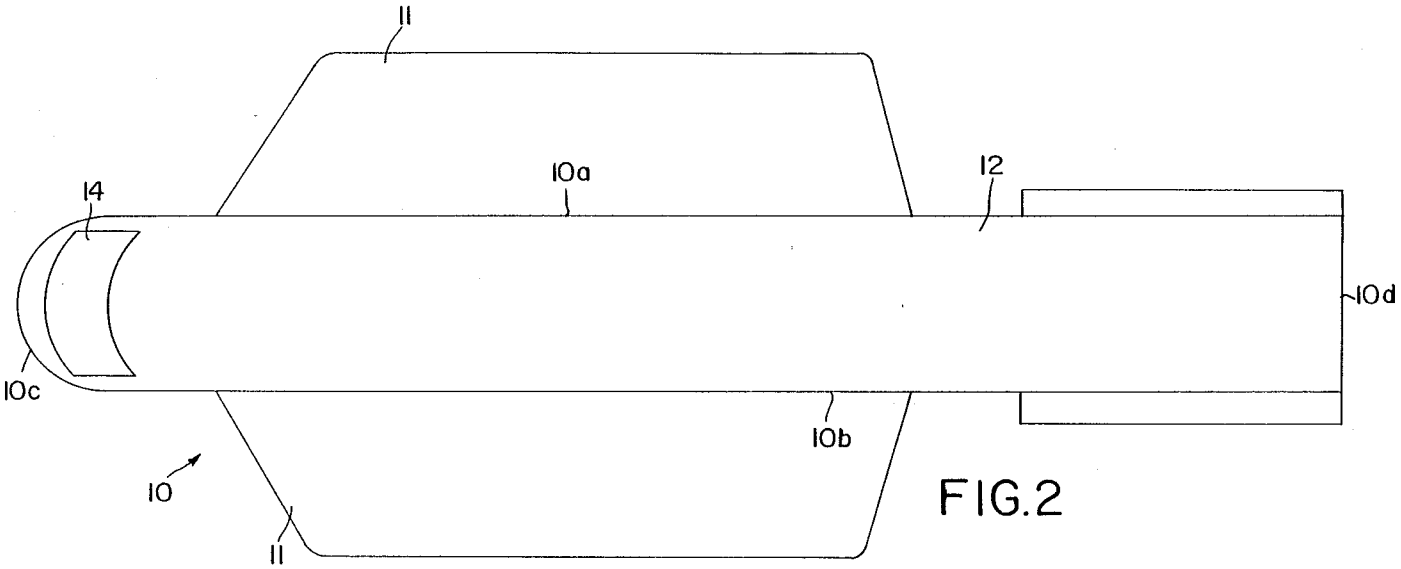
FIG. 2 is a plan view of the vehicle shown in FIG. 1 showing the wings 11.
Figure 3:
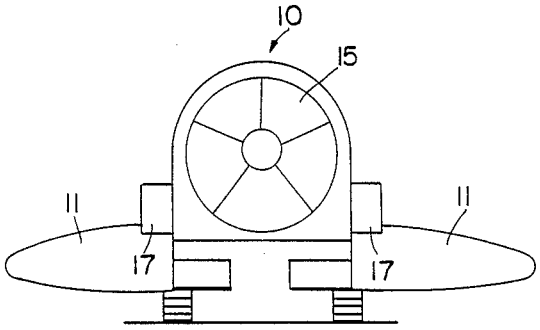

FIG. 3 is a right end view of the vehicle 10 shown in FIGS. 1 and 2 showing the engine 15.

Figure 4:
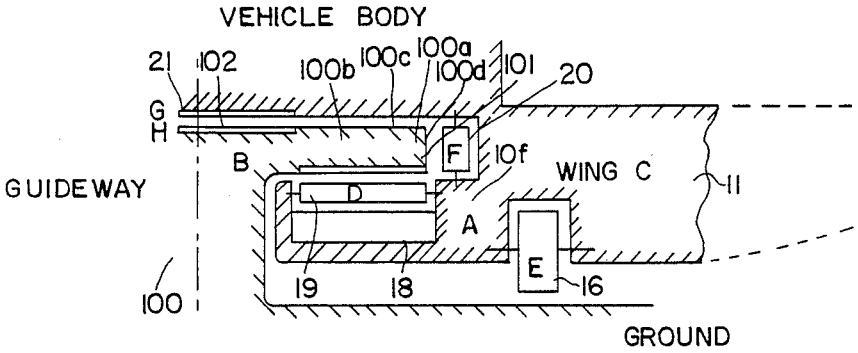

FIG. 4 is a partial cross-sectional view along lines 4—4 of FIG. 1 which are identical showing the magnets 18 on the vehicle 10 which are attracted to the material 101 mounted on an underside **100*a* of the rail 100**.

Figure 5:
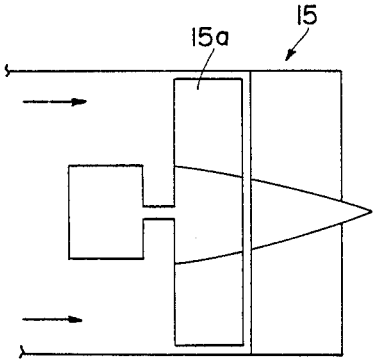

FIG. 5 is a side partial cross-sectional view of the engine 15 at the rear **10*d* of the vehicle 10**.

Figure 6:
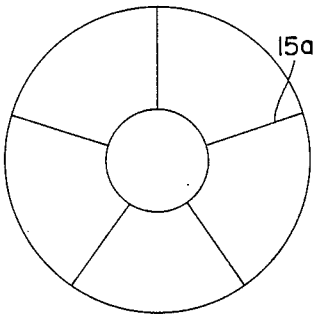

FIG. 6 is an end view of the fan shown in FIG. 5.

GENERAL DESCRIPTION

The present invention relates to a vehicle having a longitudinal axis and having opposed front and rear ends and sides between the ends and having motor means for propelling the vehicle, wherein the vehicle travels along the axis along cross-sectionally T-shaped rails in a cross-sectionally T-shaped slot along an underside of the vehicle between the ends and wherein magnetic attraction means in the underside of the vehicle and along the rail produce an attraction between the rail and the vehicle to provide levitation, the improvement which comprises: a fuselage mounting wings so as to provide aerodynamic lift to the vehicle thereby reducing the amount of magnetic attraction needed to levitate the vehicle as it is propelled on the rail.

In particular the present invention relates to a vehicle for travel along a rail which comprises: an enclosed fuselage having a longitudinal axis, a front end, a rear end opposite the front end and opposed sides between the ends and having a cross-sectionally T-shaped slot along and parallel to the axis of the fuselage for mounting the fuselage on a cross-sectionally T-shaped rail having a cross-member wherein the T-shaped slot is defined by spaced apart arms projecting from under the fuselage around an underside of the cross-member of the T-shaped rail; at least four wheels mounted on the fuselage for contacting a surface which supports the fuselage on the wheels when at rest; wings mounted on the sides of the fuselage to which provide lift when the vehicle is in motion; magnetic attraction means mounted on the underside of the cross member of the T-shaped rail and on a top side of the arms of the fuselage such that the arms and cross-member are spaced apart when the wheels are on the ground; first roller means mounted on the arms between the magnetic attraction means and the cross-member such that the first roller means rides on the underside of the cross-member when the vehicle is in motion, wherein the first roller means has an axis of rotation which is horizontal and perpendicular to the axis of the fuselage; second roller means mounted adjacent the arms and spaced from opposed ends of the cross-member of the T-shaped rail and having a vertical axis of rotation perpendicular to the axis of the fuselage and the first roller means; and propulsion means mounted at the rear of the fuselage for propelling the vehicle along the T-shaped rail such that when the vehicle is propelled the combination of lift from the wings and surface, and wherein the first and second roller means guide the vehicle along the rail.

SPECIFIC DESCRIPTION

FIGS. 1 to 3 show the vehicle 10. The vehicle 10 includes wings 11 and a fuselage 12. The windows 13 are provided along the sides 10*a* and 10*b* and a front window 14 is provided for the pilot at a front 10*c* of the fuselage 12. An engine 15, preferably a fan jet or turbine engine, is mounted at the rear 10*d* of the fuselage 12. Wheels 16 are mounted on the fuselage 12 and are mounted on an underside 10*e* of the fuselage 12. Air ducts 17 are provided on either side 10*a* and 10*b* of the fuselage 12 for supplying air to the engine 15.

As shown in FIG. 4, the guideway rail 100 is in the form of a T, with a magnetic attractable material 101 mounted on an underside 100*a* of cross member 100*b*. Magnets 18 (which can be permanent magnets or electro magnets) are carried by the vehicle 10 on spaced apart arms 10*f* and are attracted to the guideway rail 100, thus providing levitation of the vehicle 10. The magnets 18, however, never touch the guideway rail 100, because the magnets 11 are separated from the rail 100 by rollers 19 mounted on the arm 10f, and so there is no possibility of lock-up of the material 100 and magnets 18. Side rollers 20 engage opposed ends 100*d* of the cross-member 100*b*.

FIG. 5 shows the air flow (arrows) into the engine 15. The engine 15 includes a fan 15*a*.

In operation, wheels 16 touch the ground at starting and low speeds of the vehicle 10. Magnetic levitation is operating only lightly. As the vehicle 10 picks up speed, aerodynamic lift by the wings 11 takes effect, and magnets 18 move nearer to the underside 100*a* of the rail 100. Magnetic levitation is now increased, and together with the aerodynamic lift of the wings 11, the vehicle 10 becomes suspended. The equilibrium forces on the vehicle 10 are its weight, the magnetic attraction and aerodynamic lift, the drag resistance, and the engine 15 thrust.

Optionally, braking may be enhanced by magnet 21, which when energized, is attracted to a material 102 on the upper portion 100*c* of the guiderail, thereby pressing the vehicle 10 toward the ground, at which point the wheels 16 take over.

In particular the present invention provides:

(1) a light-weight fuselage 12 with wings 11 on the sides 10*a* and 10*b* to generate lift and enhance magnetic levitation.

(2) wheels 16 to touch ground while the vehicle 10 is resting or moving slowly on guideway rail 100.

(3) a combination method of magnetic and aerodynamic levitation for the vehicle 10.

(4) a light-weight propulsion system using an engine 15, preferably a turbine or fan jet, to minimize weight and electric power requirements.

(5) rollers 19 maintain the vertical stability of the vehicle 10.

10 (6) wheels 16 provide steer enhancement and cornering of the vehicle 10.

(7) rollers 20 on the sides of the cross member 100*b* keep the vehicle 10 in alignment with the guideway rail 100.

(8) permanent or electromagnets 18 can be used in lieu of superconductors to minimize weight, power and/or cryogenic requirements.

(9) a magnetic attraction means including material 102 and magnets 21 can be used for braking.

(10) a T-shaped rail 100 with a material 101 on the underside can be used for magnetic attraction.

(11) a short turning radius is obtainable by controlling the distance between rollers 20 abutting the sides of the T-rail.

It is intended that the foregoing description be only illustrative and that the present invention be limited only by the hereinafter appended claims.

I claim:

1. A vehicle for travel along a rail which comprises:

(a) an enclosed fuselage having a longitude axis, a front end, a rear end opposite the front end and opposed sides between the ends and having a cross-sectionally T-shaped slot along and parallel to the axis of the fuselage adapted for mounting the fuselage on a cross-sectionally T-shaped rail the rail having a cross-member including spaced apart arms projecting horizontally under the fuselage wherein the T-shaped slot is around an underside of the arms of the cross-member of the T-shaped rail;

(b) at least four wheels mounted on the fuselage for contacting a surface which supports the fuselage on the wheels when at rest;

(c) wings mounted on the sides of the fuselage to which provide lift when the vehicle is in motion;

(d) magnetic attraction means mounted on the underside of the cross member of the T-shaped rail and on a top side of the arms of the fuselage such that the arms and cross member are spaced apart when the wheels are on the ground;

(e) first roller means mounted on the arms between the magnetic attraction means and the cross-member such that the first roller means rides on the underside of the cross-member when the vehicle is in motion, wherein the first roller means has an axis of rotation which is horizontal and perpendicular to the axis of the fuselage;

(f) second roller means mounted adjacent the arms and spaced from opposed ends of the cross member of the T-shaped rail and having a vertical axis of rotation perpendicular to the axis of the fuelage and the first roller means; and (g) propulsion means mounted at the rear of the fuselage for propelling the vehicle along the T-shaped rail such that when the vehicle is propelled the combination of lift from the wings and lift from the magnetic attraction means raises the wheels from the surface, and wherein the first and second roller means guide the vehicle along the rail.

2. The vehicle of claim 1 wherein the propulsion means is a jet propulsion engine.

3. The vehicle of claim 1 wherein the vehicle has windows in the fuselage, wherein doors are provided on at least one of the sides of the fuselage above the wings and wherein the vehicle has seating for carrying passengers.

4. The vehicle of claim 1 wherein the wheels are provided with a braking means and wherein spaced apart second magnetic attraction means are provided on the underside of the fuselage between the wheels and on a top portion of the cross member of the T-shaped rail such attraction of the second magnetic attraction means to cause the wheels of the vehicle to contact the ground for braking.

* * * * *

UNITED STATES PATENT AND TRADEMARK OFFICE

CERTIFICATE OF CORRECTION

PATENT NO. : 4,941,406

DATED : July 17, 1990

INVENTOR(S) : Joachim E. Lay

It is certified that error appears in the above—identified patent and that said Letters Patent is hereby corrected as shown below:

Column 3, line 37, after "and" (first occurrence) and before "surface" the following should be inserted --lift magnetic attraction means raises the wheels from the--.

Column 4, line 27, before "(6)" delete "10".

Column 4, line 48 (Claim 1), "longitude" should be --longitudinal--.

Signed and Sealed this

Eleventh Day of February, 1992

*Attest:*

HARRY F. MANBECK, JR.

*Attesting Officer*

*Commissioner of Patents and Trademarks*